US009510124B2

(12) United States Patent
Horbach

(10) Patent No.: US 9,510,124 B2
(45) Date of Patent: Nov. 29, 2016

(54) PARAMETRIC BINAURAL HEADPHONE RENDERING

(75) Inventor: Ulrich Horbach, Canyon Country, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 614 days.

(21) Appl. No.: 13/419,806

(22) Filed: Mar. 14, 2012

(65) Prior Publication Data

US 2013/0243200 A1 Sep. 19, 2013

(51) Int. Cl.
*H04R 5/00* (2006.01)
*H04S 3/00* (2006.01)

(52) U.S. Cl.
CPC ..... *H04S 3/004* (2013.01); *H04S 2400/01* (2013.01)

(58) Field of Classification Search
CPC ..... H04S 1/002; H04S 3/00; H04R 5/04
USPC ..... 381/1, 2, 17–20, 26, 74, 307, 309, 310
See application file for complete search history.

(56) References Cited

U.S. PATENT DOCUMENTS

2006/0083394 A1* 4/2006 McGrath ..... H04S 3/00 381/309
2006/0133628 A1* 6/2006 Trivi ..... G10H 1/0066 381/310
2008/0031462 A1* 2/2008 Walsh ..... H04S 3/02 381/17
2009/0043591 A1* 2/2009 Breebaart et al. ..... 704/500
2010/0303246 A1* 12/2010 Walsh ..... H04S 3/00 381/18

OTHER PUBLICATIONS

MusicTech, Notch Filtering, 2011, p. 3-7.*
Kirkeby, *A Balanced Stereo Widening Network for Headphones,* AES 22nd International Conference on Virtual, Synthetic and Entertainment Audio; (4 pages).
Lorho et al., *Round Robin Subjective Evaluation of Stereo Enhancement Systems for Headphones,* AEW 22nd International Conference on Virtual Synthetic and Entertainment Audio, (10 pages).

* cited by examiner

*Primary Examiner* — Vivian Chin
*Assistant Examiner* — William A Jerez Lora
(74) *Attorney, Agent, or Firm* — Brooks Kushman P.C.

(57) ABSTRACT

A sound enhancement system (SES) that can enhance reproduction of sound emitted by headphones and other sound systems. The SES improves sound reproduction by simulating a desired sound system without including unwanted artifacts typically associated with simulations of sound systems. The SES facilitates such improvements by transforming sound system outputs through a set of one or more sum and cross filters, where such filters have been derived from a database of known direct and indirect head-related transfer functions (HRTFs).

19 Claims, 12 Drawing Sheets

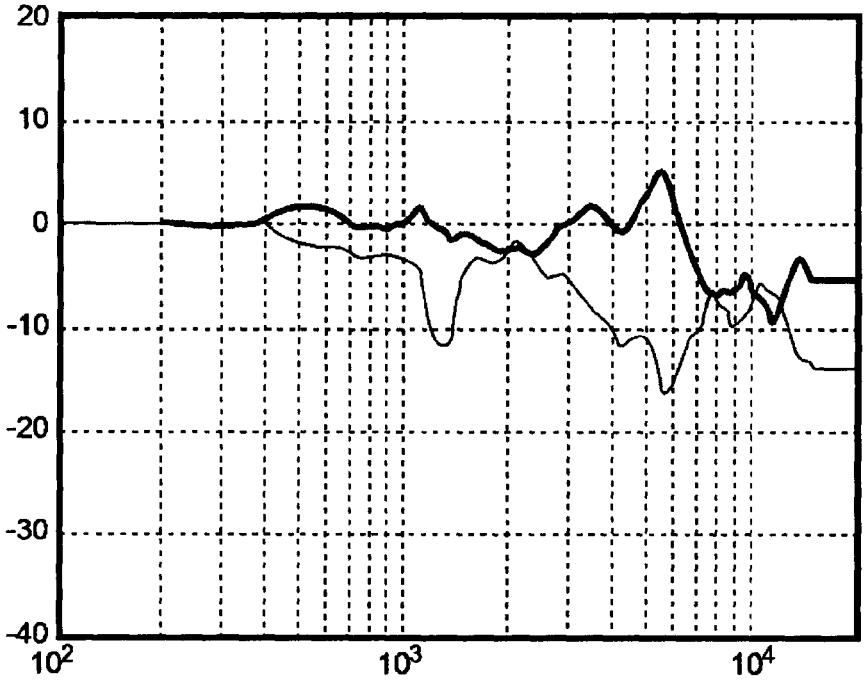
Figure 7
Figure 8
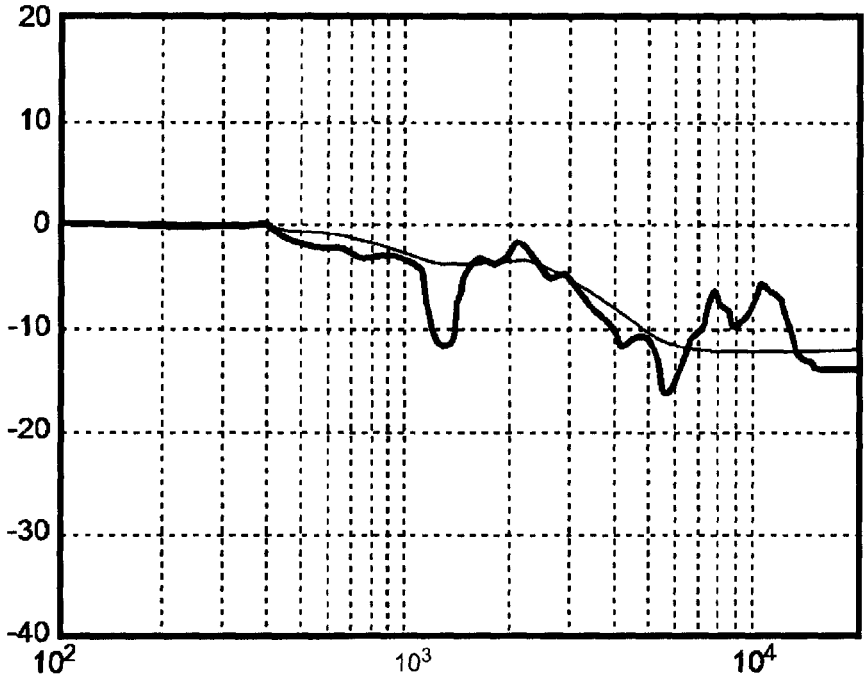

PARAMETRIC BINAURAL HEADPHONE RENDERING

BACKGROUND OF THE INVENTION

1. Technical Field

The present disclosure relates to systems for enhancing audio signals, and more particularly to systems for enhancing sound reproduction over headphones.

2. Related Art

There have been advancements in the recording industry. One of these advancements is the reproduction of sound from a multiple channel sound system, such as reproducing sound from a surround sound system. These advancements have enabled listeners to enjoy enhanced listening experiences, especially through surround sound systems such as 5.1 and 7.1 surround sound systems. Even two-channel stereo systems have provided enhanced listening experiences through the years.

Usually surround sound or two-channel stereo recordings are recorded and then processed to be reproduced over loudspeakers, which limits the quality of such recordings when reproduced over headphones. For example, stereo recordings are usually meant to be reproduced over loudspeakers, instead of being played back over headphones. This results in the stereo panorama appearing on line in between the ears or inside a listener's head, which can be an unnatural and fatiguing listening experience.

To resolve the issues of reproducing sound over headphones, designers have derived stereo and surround sound enhancement systems for headphones; however, for the most part these enhancement systems have introduced unwanted artifacts such as unwanted coloration, resonance, reverberation, and/or distortion of timbre or sound source angle and/or position. Therefore, a need exists for enhancing the listening experience through headphones without introducing such unwanted artifacts.

SUMMARY

A sound enhancement system (SES) that can enhance reproduction of sound emitted by headphones and other sound systems. The SES improves sound reproduction by simulating a desired sound system without including unwanted artifacts typically associated with simulations of sound systems. The SES facilitates such improvements by transforming sound system outputs through a set of one or more sum and cross filters, where such filters have been derived from a database of known direct and indirect HRTFs (also known as ipsilateral and contralateral HRTFs). In headphone implementations, eventually the output of the SES are direct and indirect HRTFs, and the SES can transform any multi-channel audio signal into a two-channel signal, such as a signal for the direct and indirect HRTFs. Also, this output will maintain stereo or surround sound enhancements and limit unwanted artifacts. For example, the SES can transform an audio signal, such as a signal for a 5.1 or 7.1 surround sound system, to a signal for headphones or another type of two-channel system. Further, the SES can perform such a transformation while maintaining the enhancements of 5.1 or 7.1 surround sound and limiting unwanted amounts of artifacts.

Regarding design of the sum and cross filters, the sum and cross filters are derived from known direct and indirect HRTFs. The known direct and indirect HRTFs have been found to provide enhanced reproductions of sound, but with unwanted amounts of artifacts. As mentioned, the derived sum and cross filters avoid the unwanted artifacts and still maintain the enhanced listening experience of stereo or surround sound. Derivation of the sum and cross filters from the known direct and indirect HRTFs has been modeled through experimentation. The model can be summarized in a method that at least includes transforming the pair of known direct and indirect HRTFs to the sum and cross filters, where each of the sum and cross filters are derived through arithmetic transformations. Further, additional functions can be provided prior and subsequent to the arithmetic transformations to further enhance the design of the sum and cross filters. For example, prior to the transformation of the known direct and indirect HRTFs to corresponding sum and cross filters, the designer can normalize, smooth, and/or limit frequency band of the known direct and indirect HRTFs. Also, subsequent to the arithmetic transformation, for example, the designer can perform a low order approximation of the corresponding sum and cross filters.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The SES may be better understood with reference to the following drawings and description. The components in the figures are not necessarily to scale, emphasis instead being placed upon illustrating the principles of the invention. Moreover, in the figures, like referenced numerals designate corresponding parts throughout the different views.

FIG. 7 is a graph of the measured sum and cross filters after being transformed from the direct and indirect HRTFs, where the source's angle is 45 degrees with respect to the listener.

FIG. 8 is a graph of the measured cross filter after low-order approximation, where the source's angle is 45 degrees with respect to the listener.

DETAILED DESCRIPTION

Figure 1:
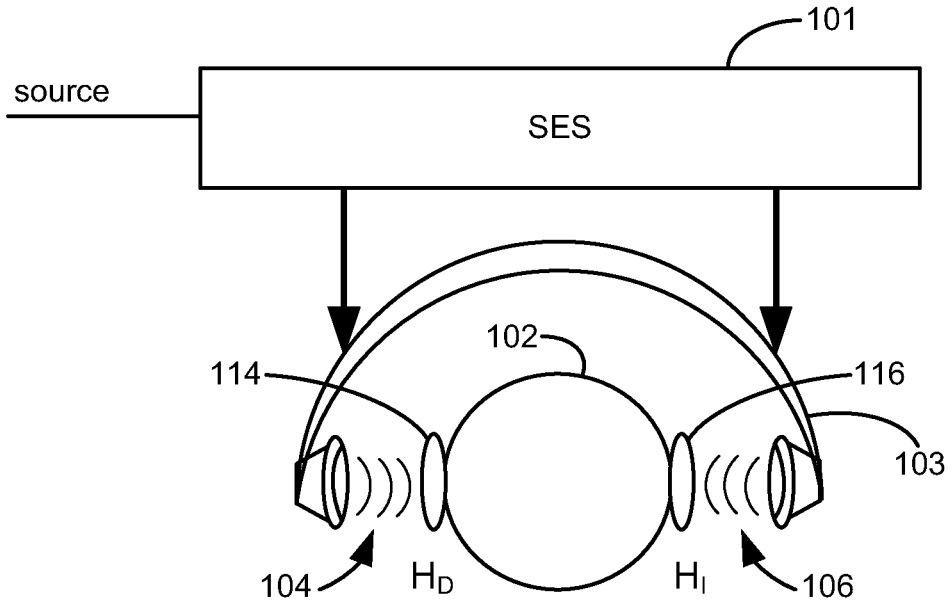
FIG. 1 is an illustration of a person receiving a direct HRTF and an indirect HRTF in the form of sound waves from an example sound system implementing an embodiment of the SES.

It is to be understood that the following description of examples of implementations are given only for the purpose of illustration and are not to be taken in a limiting sense. The partitioning of examples in function blocks, modules or units shown in the drawings is not to be construed as indicating that these function blocks, modules or units are necessarily implemented as physically separate units. Functional blocks, modules or units shown or described may be implemented as separate units, circuits, chips, functions, modules, or circuit elements. One or more functional blocks or units may also be implemented in a common circuit, chip, circuit element or unit.

In FIG. 1, depicted is an example sound system 100, implementing an example embodiment of the SES (the SES 101), which is transmitting sound waves 104 and 106 to a person 102 wearing headphones 103. These sound waves 104 and 106 if measured at the person 102 are representative of a respective direct HRTF and indirect HRTF produced by the SES 101. For the most part, the person 102 receives the sound waves 104 and 106 at each respective ear 114 and 116 by way of the headphones 103. The respective direct and indirect HRTFs that are produced from the SES 100 are specifically a result of one or more sum and cross filters of the SES 100, where the one or more sum and cross filters are derived from known direct and indirect HRTFs.

Regarding deriving the sum and cross filters from the known direct and indirect HRTFs, a designer of the filters can find the known HRTFs from a source such as the publicly available database found at the Institute de Recherche et Coordination Acoustique/Musique, Paris, France (IRCAM). An advantage of deriving the sum and cross filters from known direct and indirect HRTFs found through IRCAM is that these known HRTFs contain measured data from a significant number of tested individuals, not a simulated person. Additionally, in using this database or another source of known direct and indirect HRTFs, a designer of the sum and cross filters can model and then parameterize the sum and cross filters, so that individual listeners can adjust particular parameters to fine tune the output of the SES. As described in detail subsequently, a method used by a designer of the SES (and more particularly the sum and cross filters) can include the transformation of the known direct and indirect HRTFs to the sum and cross filters and the parameterization of the sum and cross filters. Also, in addition to describing design of the sum and cross filters, this disclosure will present example modules of example embodiments of the SES.

Figure 2:
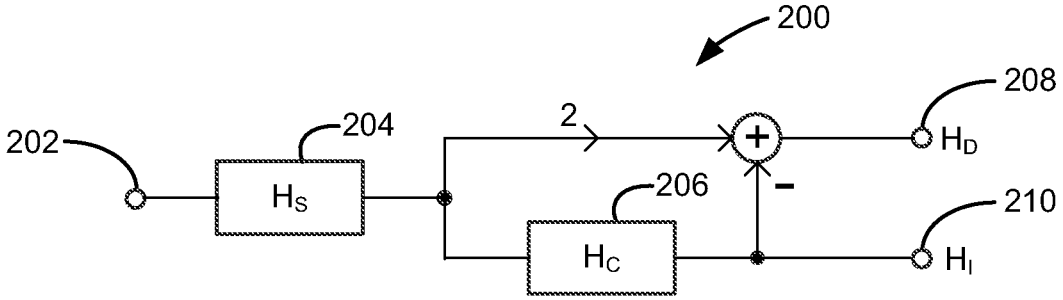
FIG. 2 is a signal flow chart of an example module of an embodiment the SES having sum and cross filters for transforming an output signal into direct and indirect HRTFs.

FIG. 2 is a signal flow diagram of an example module 200 of an embodiment of the SES having sum and cross filters 204 and 206 for transforming an audio signal, which is inputted at an input 202, into direct and indirect HRTFs that are outputted at respective outputs 208 and 210. In short, the example module 200 performs the function of transforming an audio output signal of a sound system to direct and indirect HRTFs. As suggested above, the example module 200 receives the audio output signal of the sound system at the input 202. The input 202 is connected to the sum filter 204, which is connected to the cross filter 206. Additionally, the SES multiplies, e.g., by a factor of 2, the filtered signal from the sum filter 204, and then, the SES subtracts the cross filter output from the product of the multiplication. This results in the direct HRTF. The signal outputted by the cross filter represents the indirect HRTF. Finally, respective outputs 208 and 210 output the direct and the indirect HRTF. Further, the module 200 can be combined with other audio signal processing modules to model the filters, and eventually the SES can output, via loudspeakers or headphones, enhanced sound waves representative of the HRTFs.

Regarding the sum filter 204, when applied to an audio signal it can provide spectral modifications so that such qualities of the signal are substantially similar for both ears of a listener. This filter can also eliminate undesired resonances and/or undesired peaking possibly included in the frequency response of the audio signal. As for the cross filter 206, when applied to the audio signal it provides spectral modifications so that the signal is acoustically perceived by a listener as coming from a predetermined direction or location. This functionality is achieved by adjustment of head shadowing. In both cases, it may be desired so that such modifications are unique to an individual listener's specific characteristics. To accommodate such a desire, both the sum and cross filters 206 and 204 are designed so that the frequency responses of the filtered audio signals are less sensitive to listener specific characteristics.

Figure 3:
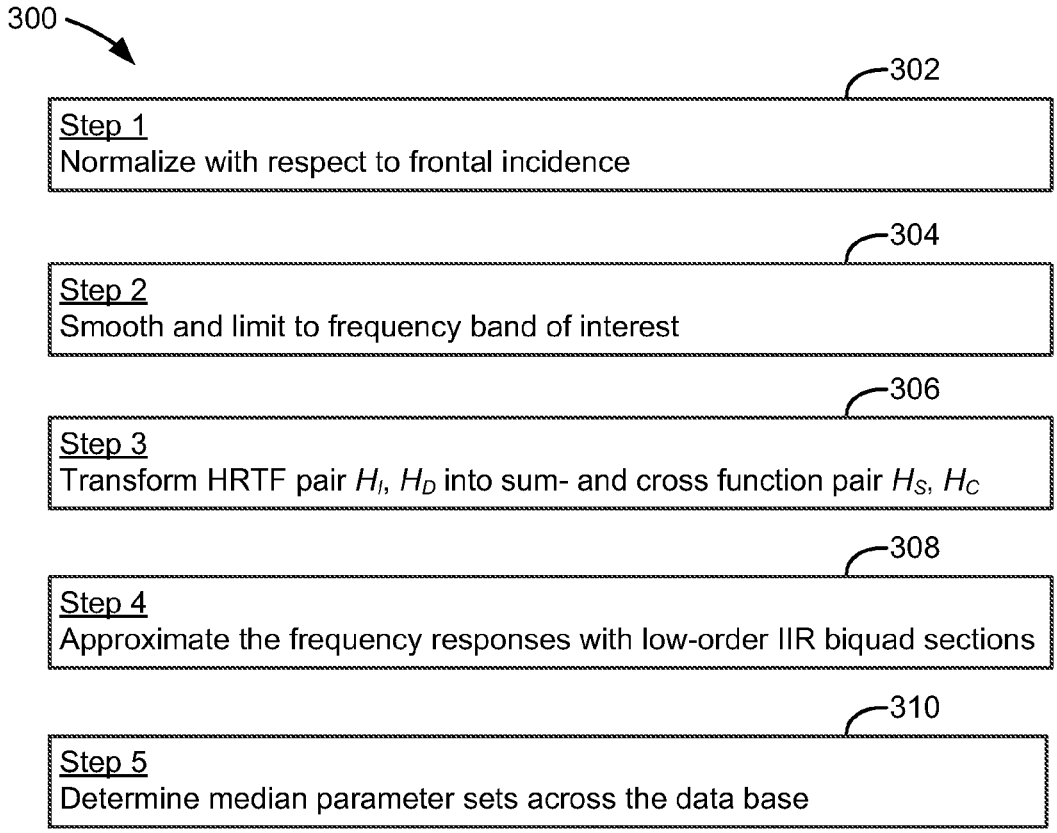
FIG. 3 is a flow diagram of various steps for processing known direct and indirect HRTFs into sum and cross filters.

Further, with respect to design of the sum and cross filters, FIG. 3 depicts an example method 300 for developing sum and cross transfer functions for respective sum and cross filters. In general, the method 300 teaches transforming known direct and indirect HRTFs to the sum and cross transfer functions, and then eventually parameterizing the sum and cross functions. Also, the method 300 can include steps for further simplifying the sum and cross transfer functions as well. Furthermore, the method 300 for deriving the sum and cross transfer functions from known direct and indirect HRTFs may include additional steps or modules that are commonly performed during signal processing that are not depicted in FIG. 3, such as moving data within memory and generating timing signals. Also, these steps can be performed with more steps or functions in parallel.

Figure 4:
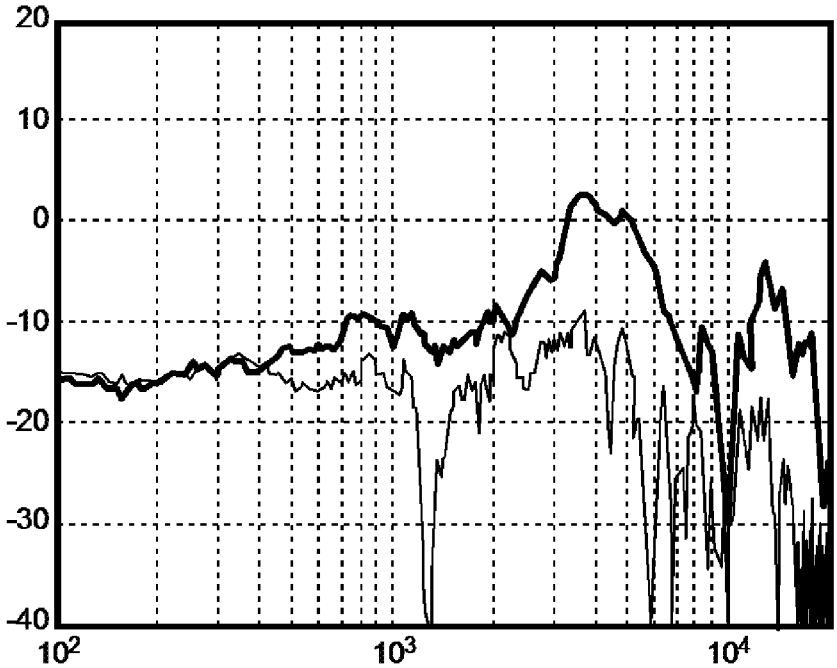
FIG. 4 is a graph of measured direct and indirect HRTFs prior to normalization, where the source's angle is 45 degrees with respect to the listener.
Figure 5:
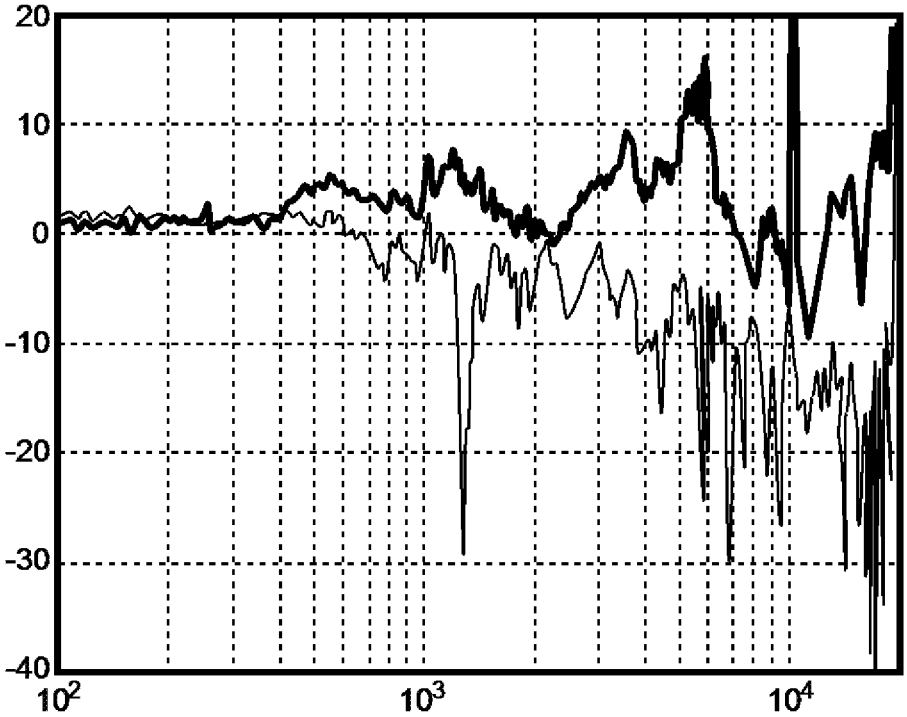
FIG. 5 is a graph of the measured direct and indirect HRTFs after normalization, where the source's angle is 45 degrees with respect to the listener.

The method 300 begins at a step 302, where a design system normalizes the direct and indirect HRTFs. Normalization can occur by subtracting a measured frontal HRTF, which is the HRTF at 0 degrees, from the indirect and direct HRTF. This form of normalization is commonly known as "free-field normalization," because it typically eliminates the frequency responses of test equipment and other equipment used for measurements. This form of normalization also ensures that timbres of respective frontal sources are not altered. In FIG. 4, depicted is a graph of measured known direct and indirect HRTFs prior to being normalized at the step 302. FIG. 5, depicts a graph of the measured direct and indirect HRTFs after the normalization at the step 302. In these graphs and a number of subsequently described graphs, the angle in which the signal source outputs the HRTFs with respect to the listener is 45 degrees.

Next, at a step 304, the design system performs a smoothing function on the normalized direct and indirect HRTFs. Additionally, at the step 304, the design system can limit the normalized HRTFs to a particular frequency band. This limiting of the HRTFs to a particular frequency band can occur before or after the smoothing function. Specifically, a frequency band that cuts off peaks at 15 kHz has been discovered to be advantageous. An example of the smoothing function, which can be in the logarithmic frequency domain A(1:N) can be carried out in accordance with the following MATLAB instructions. For the sake of convenience, this function and following functions presented using the MATLAB syntax; however, such function could be taught using other known programming languages.

```
for i=1:N
i1=max(floor(i/sm),1);
i2=min (floor(i*sm),N);
As(i)=mean(A (i1:i2));
end
```

Figure 6:
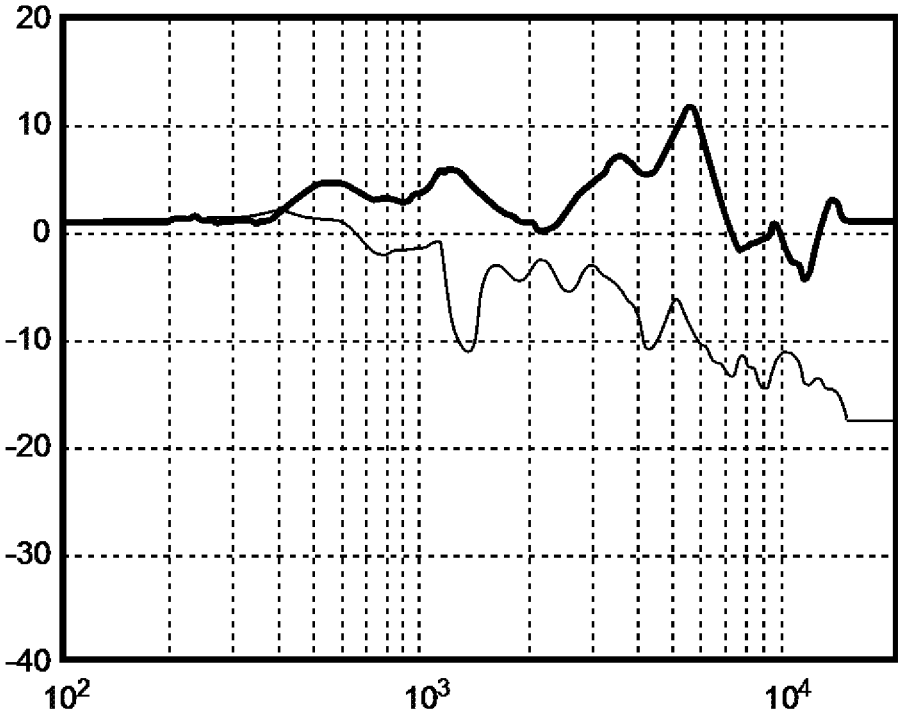
FIG. 6 is a graph of the measured direct and indirect HRTFs after smoothing, where the source's angle is 45 degrees with respect to the listener.

In the preceding instructions: "N" represents the number of frequency samples; "sm" represents a smoothing coefficient (typically sm=1.1); and above the frequency band that cuts off peaks, the values of function "A" are replaced by constants identical with the cutoff frequency. In FIG. 5, depicted is a graph of the measured direct and indirect HRTFs after normalization. FIG. 6 depicts a graph of the measured direct and indirect HRTFs after the design system performs the above MATLAB instructions or similar processor executable instructions. Also, FIG. 6 depicts a graph of the measured direct and indirect HRTFs after normalization, smoothing, and clipping.

Next, at a step 306, the design system performs the transformation from the direct and indirect HRTFs to the sum and cross transfer functions. Specifically, at the step 306, the design system computes the arithmetic average of the direct HRTF and the indirect HRTF that results in the sum transfer function. Also, the design system divides the indirect HRTF by the sum function that results in the cross transfer function. The relationship between these transfer functions is described by the following equations; where $H_D$=the direct HRTF, $H_I$=the indirect HRTF, $H_S$=the sum transfer function, and $H_C$=the cross transfer function.

$$H_S=(H_D+H_I)/2 \quad H_C=H_I/H_S$$

$$H_D=H_S(2-H_C)$$

With respect to FIG. 7, depicted is a graph of the measured sum and cross transfer functions after being transformed from the direct and indirect HRTFs. Apparent from FIG. 7, the sum function is relatively flat over a large frequency band in the case where the source angle is 45 degrees. It has also been discovered with regard to enhancing the sound perceived by a listener, that the sum transfer function for the most part corrects the timbre, and the cross function corrects the head shadowing, where head shadowing refers to a quality corresponding to location of the sound wave sources.

Next, at a step 308, the design system performs a low order approximation on the sum and cross transfer functions. To perform the low order approximation, the design system can use a recursive linear filter, such as a combination of cascading biquad filters. An example implementation using cascading biquad filters is represented by the following MATLAB instructions.

First set:

```
K=tan(pi*f/fs);
vg=10^(a/20);
bz=[vg+sqrt(vg)/Q*K+K^2, 2*(K^2-vg), vg-
sqrt(vg)/Q*K+K^2];
az=[1+K/Q+K^2, 2*(K^2-1), 1-K/Q+K^2];
```

Second set:

```
K=tan(pi*f/fs);
vgn=10^(a/20);
u=1+K/Q+K^2;
bn=[1+vgn/Q*K+K^2, 2*(K^2-1), 1-vgn/Q*K+K^2]/u;
an=[1, 2*(K^2-1)/u, (1-K/Q+K^2)/u];
```

The first set of MATLAB instructions represents high shelving filters with the parameters "f" (representing corner frequency), "Q" (representing quality factor), and "a" (representing gain in dB). A sample rate is denoted by "fs", and can be 44.1 kHz, 48 kHz, or another sample rate. Such filters produce a numerator polynomial "bz", and a denominator "az". The second set of MATLAB instructions represents peak/notch filters with the parameters "f" (representing notch frequency), "Q" (representing quality factor), and "a" (representing gain in dB). Such filters produce polynomials bn and an.

In FIG. 8, depicted is a graph of the measured sum and cross transfer functions after the design system performs the above MATLAB instructions or similar processor executable instructions. Also, FIG. 8 is graph of the measured cross transfer functions after low-order approximation, where the source angle is 45 degrees. Also, the cross transfer function depicted in FIG. 8 is approximated by a peak filter and a high shelving filter. Further, in some embodiments, approximations can be made with multiple peak filters and multiple shelving filters or other types of filters using biquads.

Figure 15:
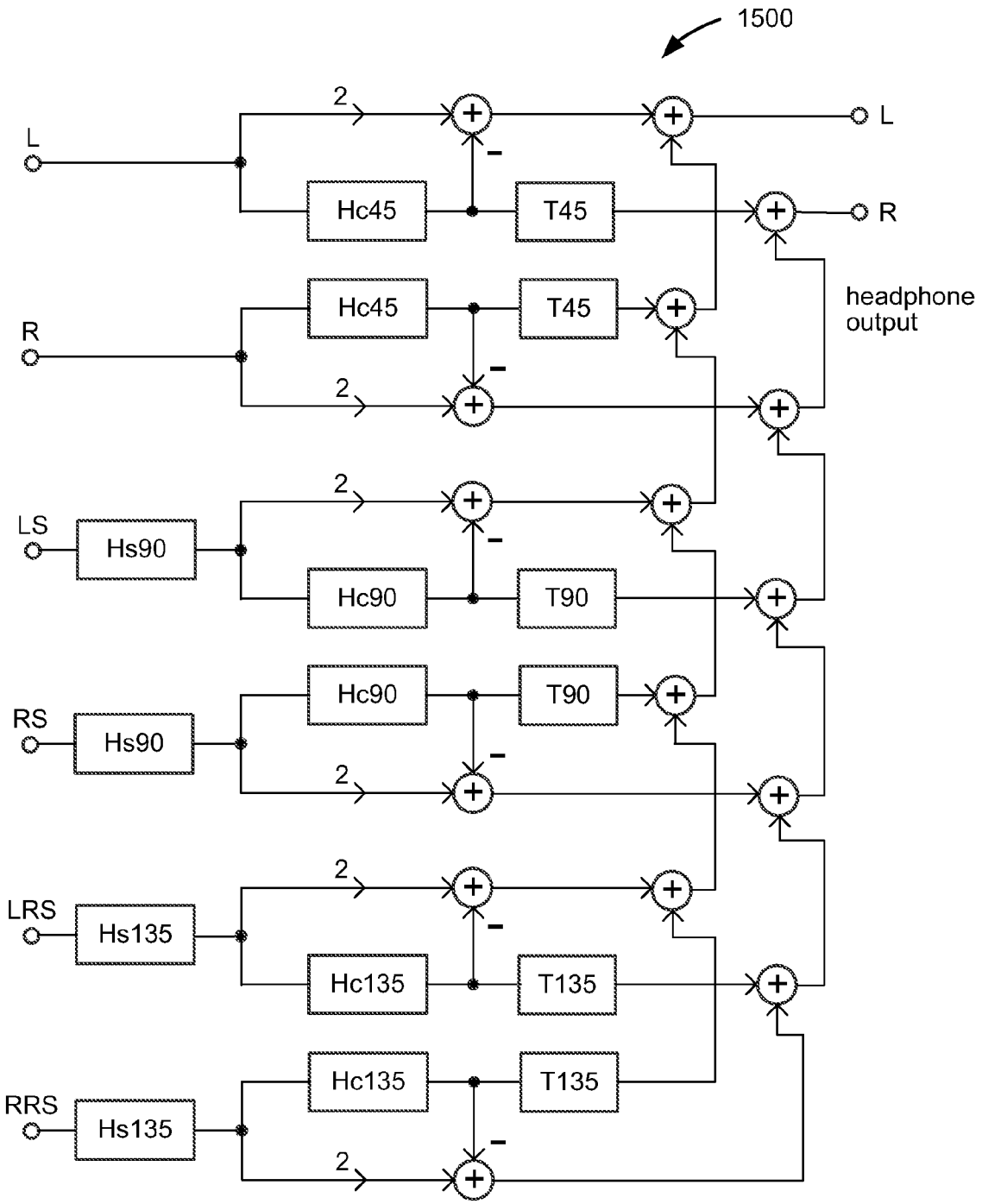
FIG. 15 is a signal flow chart of a 6-channel surround sound headphone, which is representative of an embodiment of the SES.

With respect to the sum transfer function, peak and shelving filters are not required considering the sum function is relatively flat over a large frequency band where the sound source angle is 45 degrees with respect to a listener. Also, for this reason a sum filter is not necessary when converting an audio signal outputted from a source positioned 45 degrees from the listener. As depicted in FIG. 15, sum filters are absent from the transformation of the audio signals coming from sources each having a 45 degree source angle. Alternatively, sum filters equaling a constant 1 value could be added to the implementation depicted in FIG. 15 and similar outputs would occur at the outputs labeled "L" and "R".

Figure 9:
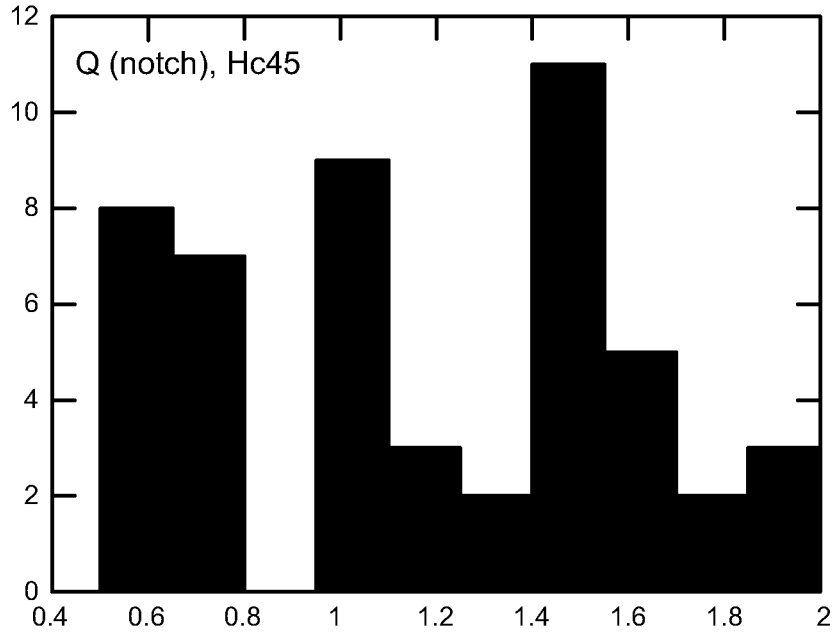
FIG. 9 is a histogram charting Q-factors for the cross filter where the source's angle is 45 degrees with respect to the listener.
Figure 10:
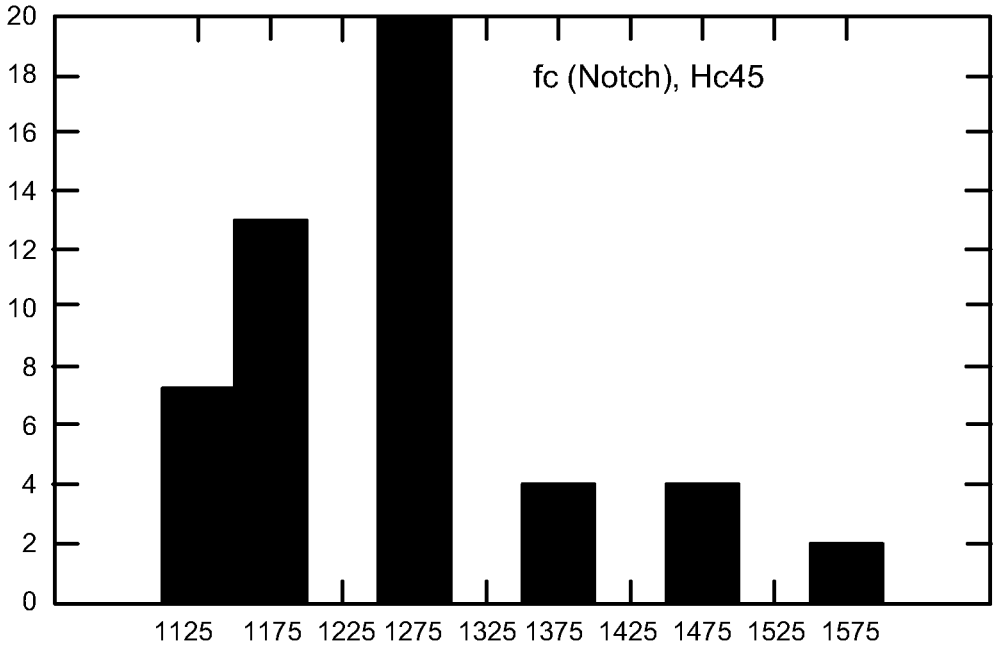
FIG. 10 is a histogram charting notch frequencies for the cross filter where the source's angle is 45 degrees with respect to the listener.
Figure 11:
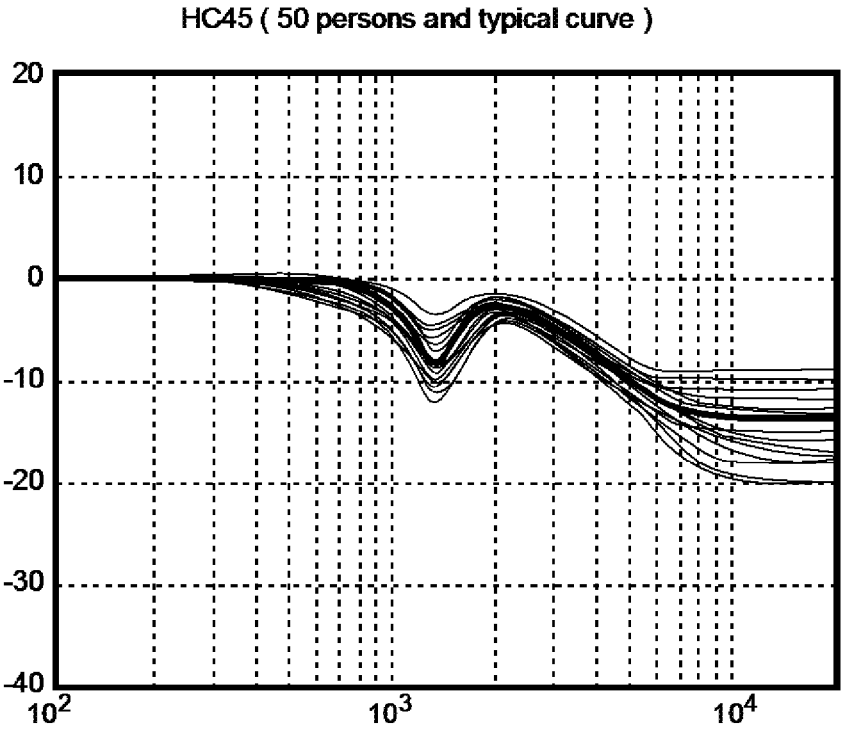
FIG. 11 is a graph of frequency responses for the cross filter where the source's angle is 45 degrees with respect to the listener, and where the filter is using median parameter values.

Finally, at a step 310 and after one or more iterations of the steps 302, 304, 306, and 308, the design system determines one or more parameters across one or more of the resulting sum transfer functions and cross transfer functions that are common to the one or more of the resulting sum transfer functions and cross transfer functions. For example, in performing the method 300 over a number of HRTF pairs from IRCAM, it was found that Q factor values of 0.6, 1, and 1.5 where common amongst the resulting notch filter in the 45 degrees cross function approximation. Therefore, in an implementation of the SES a switch can be included that allows a user of the SES to select between various Q factor values, such as 0.6, 1, and 1.5 at a source angle of 45 degrees. Such finding are found in FIG. 9, which shows a histogram of the Q factor of a notch filter section of the cross filter for a source angle of 45 degrees. Depicted are test persons versus found Q factor values. For example, there are eleven listeners with a Q factor of 1.5. By allowing selection of the Q factor value, the SES provides listeners to fine tune the audio signal. For example, on a mobile device, such as an MP3 player or a smart phone, a user, via the SES, could select a desired Q factor from a touchscreen or a mechanical switch. Further, by minimizing the number of options, such as limiting parameterization to three options, the complexity of fine-tuning a user's listening experience is reduced. Another parameter having common results observed from running the method 300, is the frequency of the notch filter section of the cross filter for a source angle of 45 degrees. It has been found by the design system, at a source angle of 45 degrees, that typically the desired filter has a notch frequency of 1275 Hz. FIG. 10 shows such findings. The histogram shows only one maximum, as opposed to three local maxima in FIG. 9. Hence this parameter can be left constant and inaccessible for possible fine tuning, thereby reducing complexity. Moreover, if we take the median values of each parameter mentioned above, we obtain filter responses such as those depict in FIG. 11. Specifically FIG. 11 shows the individual responses for 50 test subjects of the cross filter having a source angle of 45 degrees.

Figure 12:
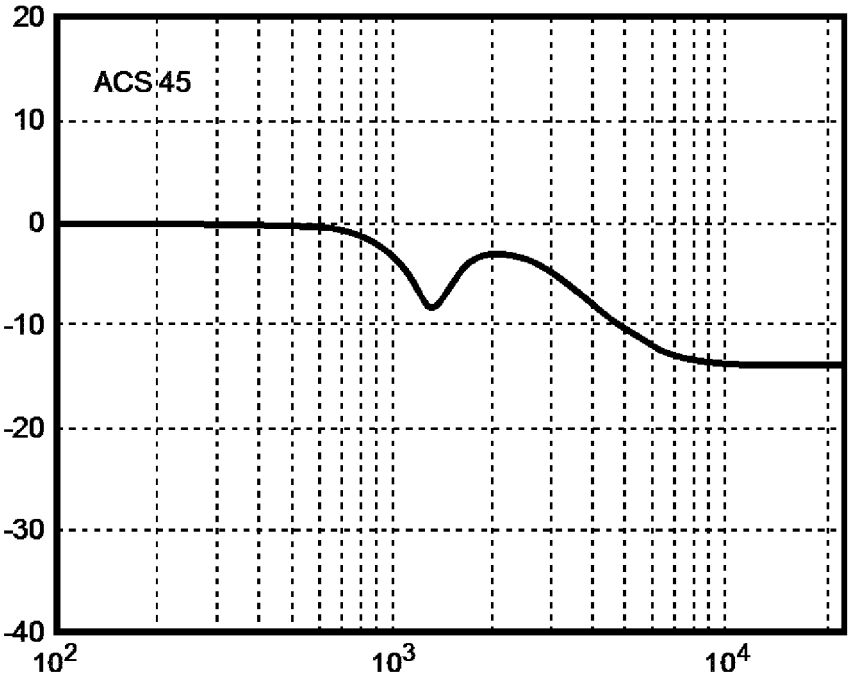
FIG. 12 is a graph of resulting sum and cross functions at 45 degrees.
Figure 13:
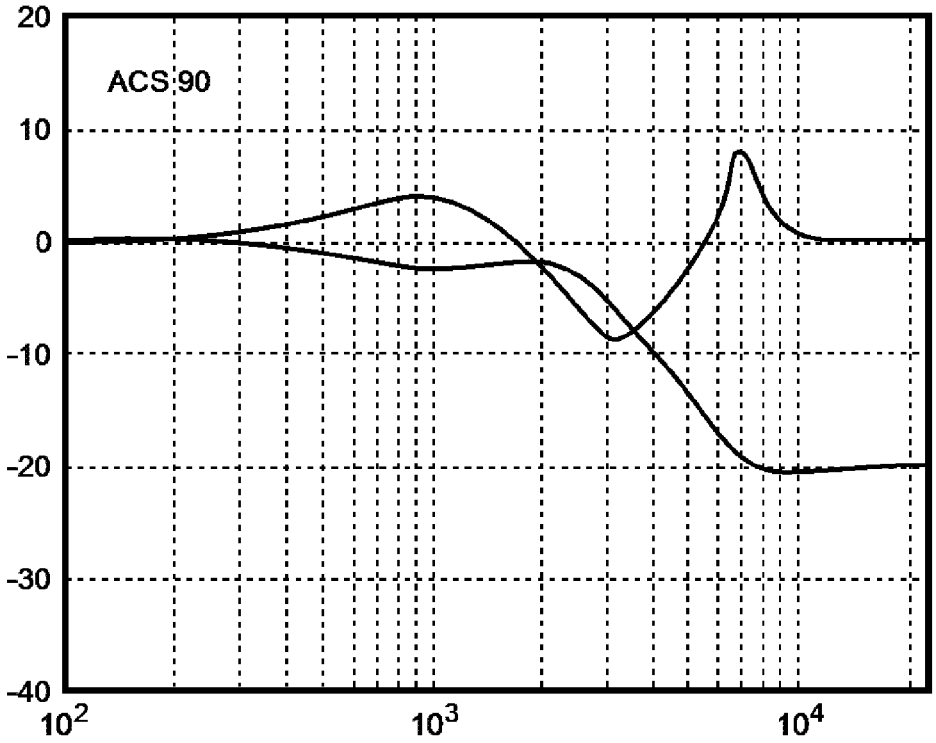
FIG. 13 is a graph of resulting sum and cross functions at 90 degrees.
Figure 14:
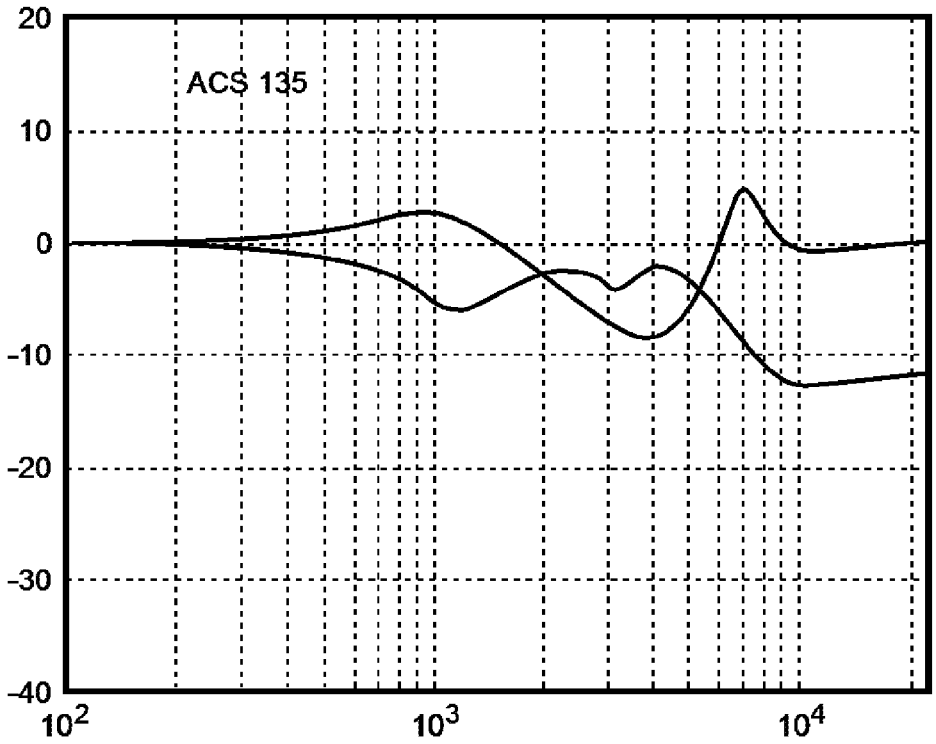
FIG. 14 is a graph of resulting sum and cross functions at 135 degrees.

Typical sum and cross transfer functions obtained through steps 302, 304, 306, 308, and 310 are depicted in FIGS. 12-14 (transfer functions for source angles 45, 90, and 135 degrees, respectively). The transfer functions of FIGS. 12-14 can be used to render a set of surround sound loudspeakers or sound sources after transformation by an embodiment of the SES. For example, front stereo sound sources can be configured at +/−45 degrees, side surround sources can be configured at +/−90, and rear surround sources can be configured at +/−135 degrees. Note again that the sum responses for the frontal renderings are flat (see FIG. 12). Therefore, the results in binaural reproduction have very low coloration or altering of the original spectral content or timbre.

Referring back to the SES, FIG. 15 is a signal flow chart that depicts an example module 1500 of an embodiment of the SES. The module 1500 is loosely based on the module 200 found in FIG. 2, with additions of interaural delays for source angles of 45, 90, and 135 degrees (labeled "T45", "T90", and "T135", respectively). These delay filters can have typical samplings of 17 samples, 34 samples, and 21 samples, respectively, at a sample rate of 48 kHz. The delay filters simulate the time a sound wave takes to reach one ear after it first reaches the other ear.

The other components of the module 1500 can transform audio signals from one or more sources to a binaural format, such as direct and indirect HRTFs. Specifically, in FIG. 15, module 1500 transforms audio signals from a 6-channel surround sound system to direct and indirect HRTFs outputted by right and left outputs of headphones (labeled "HR" and "HL" respectively). These signals outputted by the headphones will include the typically perceived enhancements of 6-channel surround sound without unwanted artifacts. Also with respect to each output of the headphones respective sets of summations are included to sum three input pairs of 6-channel surround sound. The six audio signal inputs include left, right, left surround, right surround, left rear surround, and right rear surround (labeled "L", "R", "LS", "RS", "LRS", and "RRS", respectively).

Also depicted by FIG. 15 are sum and cross filters for source angles of 45, 90, and 135 degrees (labeled "Hs90", "Hs135", "Hc45", "Hc90", and "Hc135", respectively). As noted above, sum filters are absent from the transformation of the audio signals coming from sources each having a 45 degree source angle. Alternatively, sum filters equaling a constant 1 value could be added to the implementation depicted in FIG. 15 and similar outputs would occur at the outputs labeled "L" and "R". Also, alternatively, embodiments of the SES could employ other filters for sources that have other source angles, such as 30, 80, and 145 degrees. Further, the SES or an electronic device containing the SES could store, in memory, various sum and cross filters for different source angles, so that such filters are selectable by end users. In such implementations, listeners can adjust the angles and simulated locations from which they perceive sound.

Referring back to the filters depicted in FIG. 15, from the method 300 for designing sum and cross filters, the following Table 1 of filter parameters have been determined for transforming frequency responses from a 6-channel surround sound system to headphones. In Table 1, two parameters have been identified as sufficient for individual tuning: Q factor, "Q" of the shelving section of the Hc45 filter to optimize front localization; and gain, "a" of the first notch filter of the Hc135 filter to tune localization of the rear surround channels.

TABLE 1

| | |
|---|---|
| Hc45: 2 biquads | |
| Shelving filter | Q = 0.7; f = 2500 Hz; a = −14 dB |
| Notch filter | Q = [0.5 . . . 2.0] => control parameter "front"; f = 1300 Hz; a = −10 dB |
| Hc90: 2 biquads | |
| Shelving filter | Q = 0.9; f = 2400 Hz; a = −20 dB |
| Notch filter | Q = 0.5; f = 1200 Hz; a = −3 dB |
| Hc135: 3 biquads | |
| Shelving filter | Q = 1; f = 4500 Hz; a = −12 dB |
| Notch filter 1 | Q = 0.7; f = 1200 Hz; a = [−4 . . . −10]dB => control parameter "rear" |
| Notch filter 2 | Q = 2; f = 3200 Hz; a = −5 dB |
| Hs90: 3 biquads | |
| Peak filter 1 | Q = 1; f = 1000 Hz; a = 5 dB |
| Peak filter 2 | Q = 5; f = 7000 Hz; a = 10 dB |
| Notch filter | Q = 0.6; f = 3200 Hz; a = −10 dB |
| Hs135: 3 biquads | |
| Peak filter 1 | Q = 1.2; f = 1000 Hz; a = 4 dB |
| Peak filter 2 | Q = 4; f = 7000 Hz; a = 10 dB |
| Notch filter | Q = 0.5; f = 4000 Hz; a = −10 dB |

Figure 16:
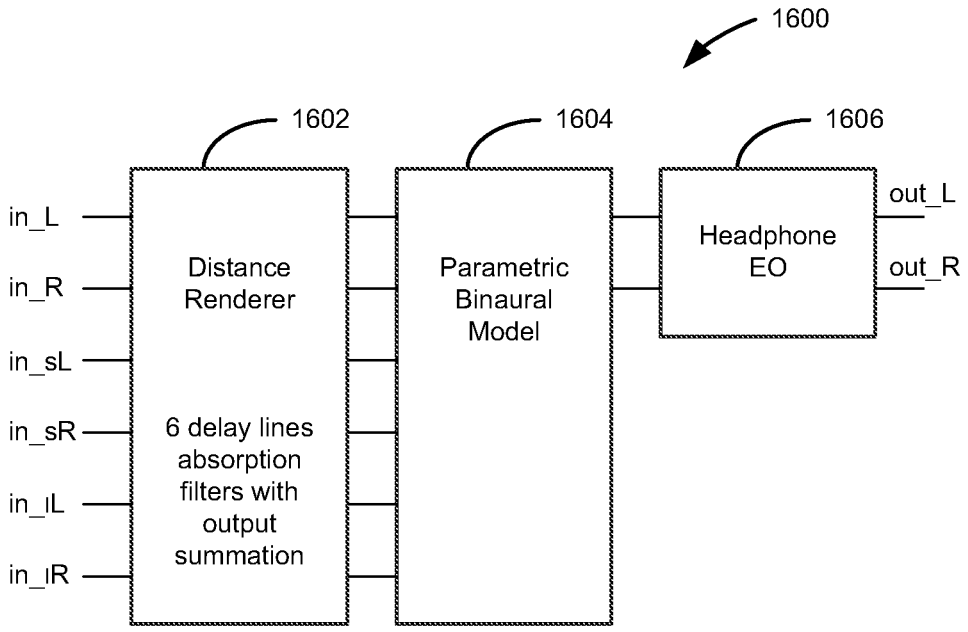
FIG. 16 is a block diagram of a 6-channel surround sound headphone with a distance renderer and an equalizer, which is representative of an embodiment of the SES.

In FIG. 16, depicted is a block diagram that depicts an example module 1600 of an embodiment of the SES. The module 1600 combines a distance renderer module 1602 with a parametric binaural module 1604 (such has the module 1500 of FIG. 15) and a headphone equalizer module 1606. Specifically, the module 1600 could be implemented for transformation of audio signals from 6-channel surround to direct and indirect HRTFs for headphones. This is because the module 1600 includes six initial inputs, and right and left outputs for headphones.

Figure 17:
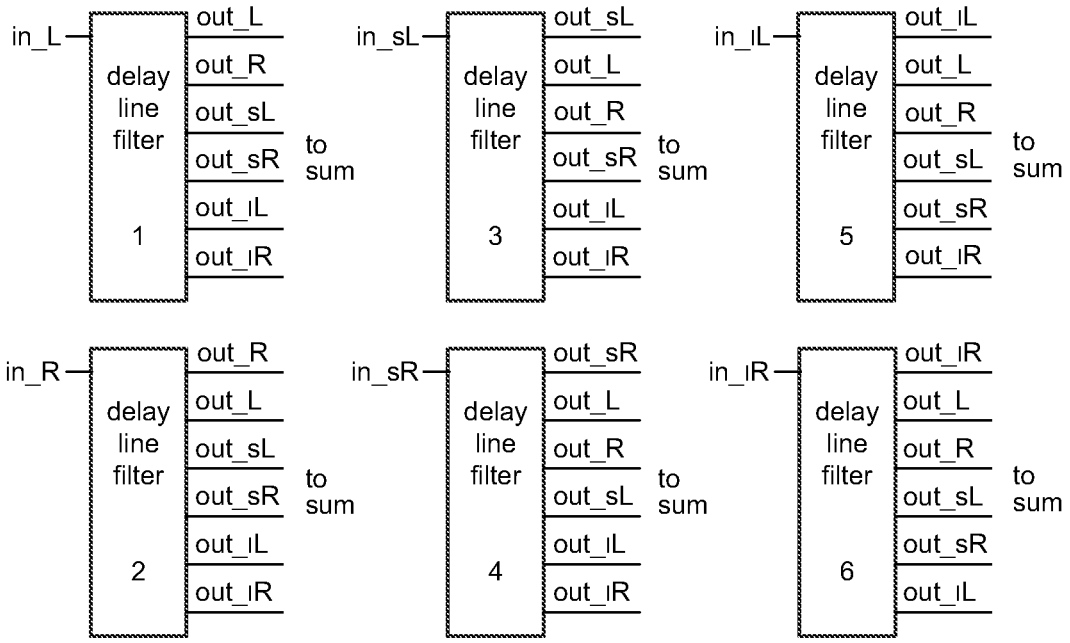
FIG. 17 is a block diagram of the example distance renderer of FIG. 16.

With respect to the distance and location rendering, the binaural model of the module 1604 provides directional information, but sound sources still appear very close to the head of a listener. This is especially the case if there is not much information with respect to the location of the sound source (e.g., dry recordings are typically perceived as being very close to the head or even inside the head of a listener). The distance renderer module 1602 limits such unwanted artifacts. As described in FIG. 17, the distance renderer module comprises six delay lines, one per each of the initial input signals, respectively. In an embodiment of the SES, one or more tapped delay lines can be used. As for output of each delay line, there are six with each output representing one of the six initial inputs, respectively, as depicted in FIG. 17. Further, the distance renderer module 1602 provides for summing its six outputs to be inputted into the parametric binaural module 1604, as taught by FIGS. 16 and 17. Finally, the headphone equalizer module 1606, which follows the parametric binaural module 1604 to further reduce coloration and improve quality of rendered HRTFs and localization.

Figure 18:
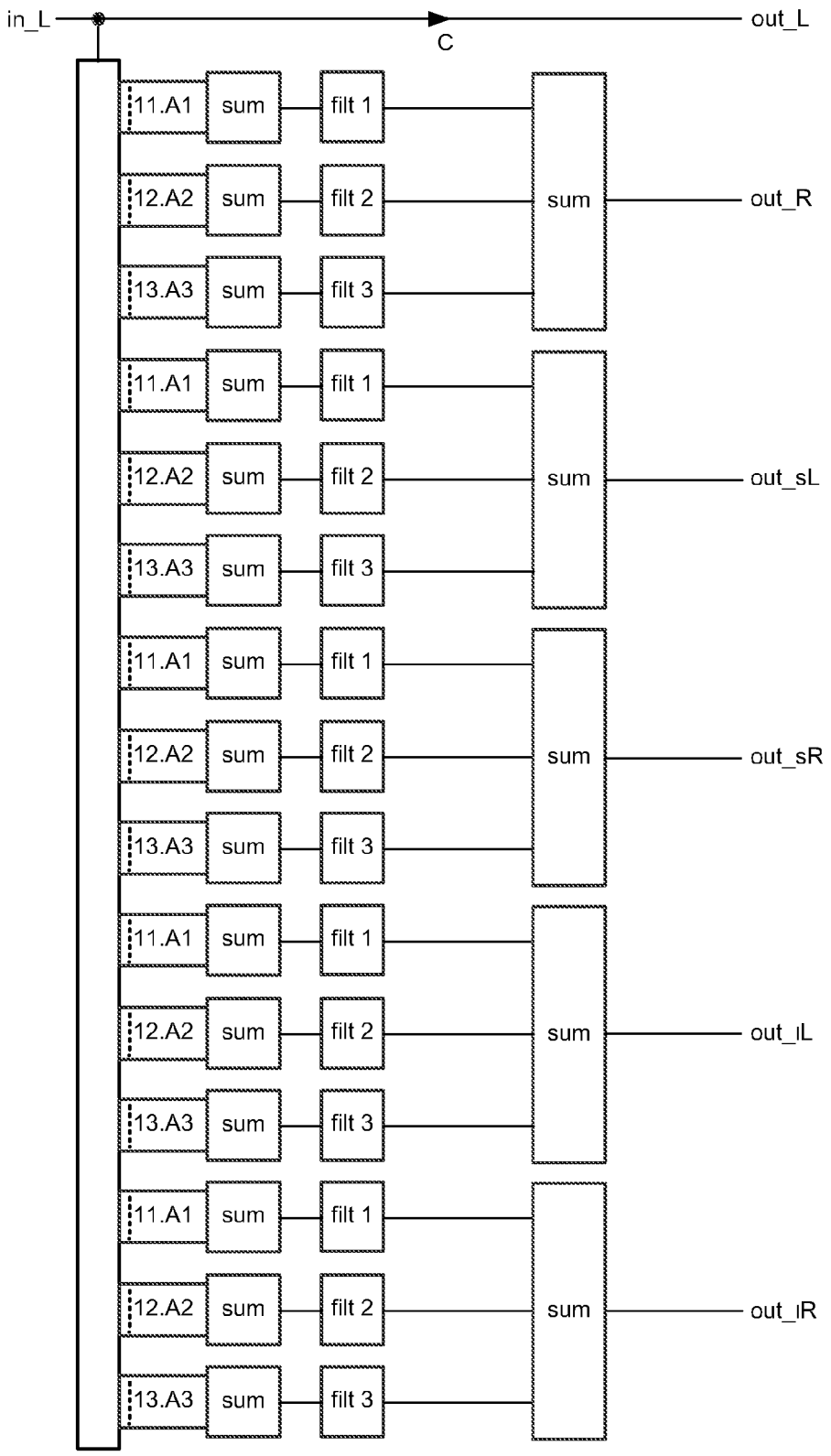
FIG. 18 is a block diagram of an example delay line with absorption filters used by an embodiment of the SES.

In FIG. 18, a schematic of one of the delay lines of FIG. 17 is shown in detail. In embodiments where the distance renderer module includes tapped delay lines, such lines can store approximately 5000 samples for 100 ms delay at a 48 kHz sample rate, and the total number of taps can be between 50 and 100. The taps can be arranged with summations that feed into one of three absorption filters (labeled "filt1", "filt2", "filt3"), respectively. Also, included in one of the delay lines is a direct path between each of the lines input and output (labeled "in_L" and "out_L", respectively). As shown, there is one input per line and six outputs, where five of the outputs correspond to a summation of the outputs of the three absorption filters.

One benefit of these delay lines is to generate a set of room reflections that would occur if a listener were listening to sound waves outputted from loudspeakers in a room. A greater number of taps are beneficial, as to simulate as many reflected signal sources of the room as possible. The parameters of the distance renderer can be determined with ray-tracing or geometric (mirror image) methods.

With respect to FIGS. 19-22, depicted are two graphs and two signal flow to charts that illustrate an alternative benefit of the SES besides transforming sound system audio signals to direct and indirect HRTFs. This benefit being the capability to enhance loudspeaker outputs as well. The SES or binaural techniques disclosed can also widen and enhance a stereo image without adding unwanted artifacts. For example, the SES or techniques disclosed can simulate a stereo image portraying loudspeakers being virtually beyond their physical location. Such an application would be helpful for listening to loud speakers in a small room, where without enhancements the experience can be exhausting to a listener.

Figure 19:
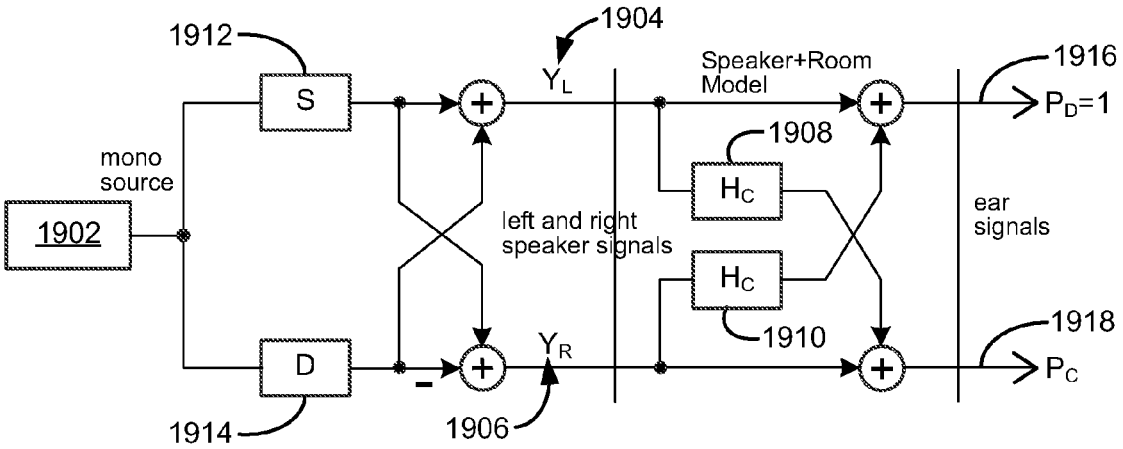
FIG. 19 is a signal flow chart of a stereo widening module used by an embodiment of the SES.
Figure 20:
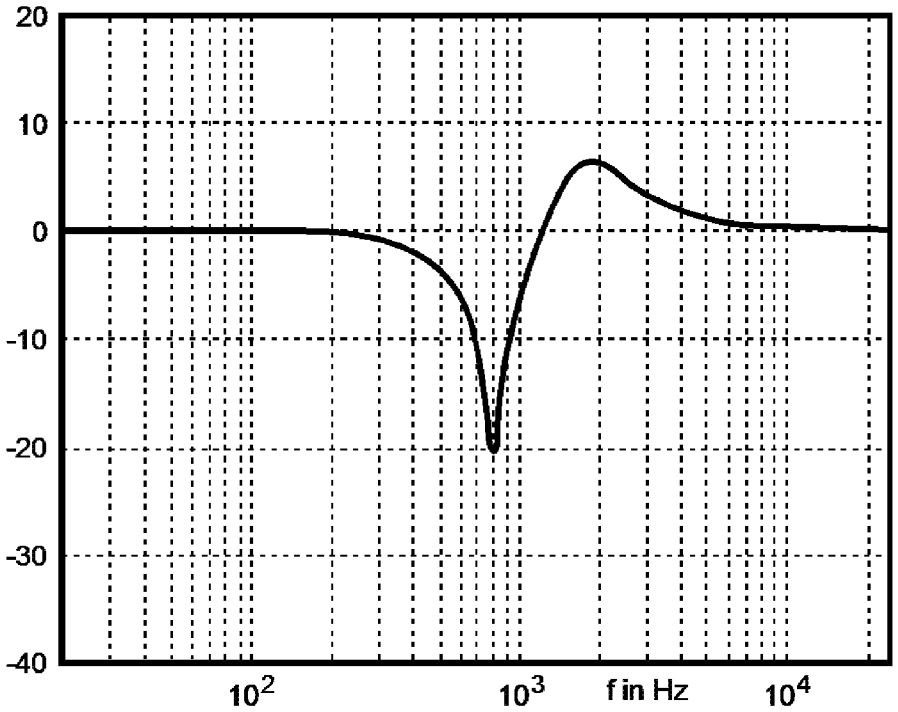
FIG. 20 is a graph of a resulting frequency response of a sum filter S of the stereo widening module of FIG. 19.
Figure 21:
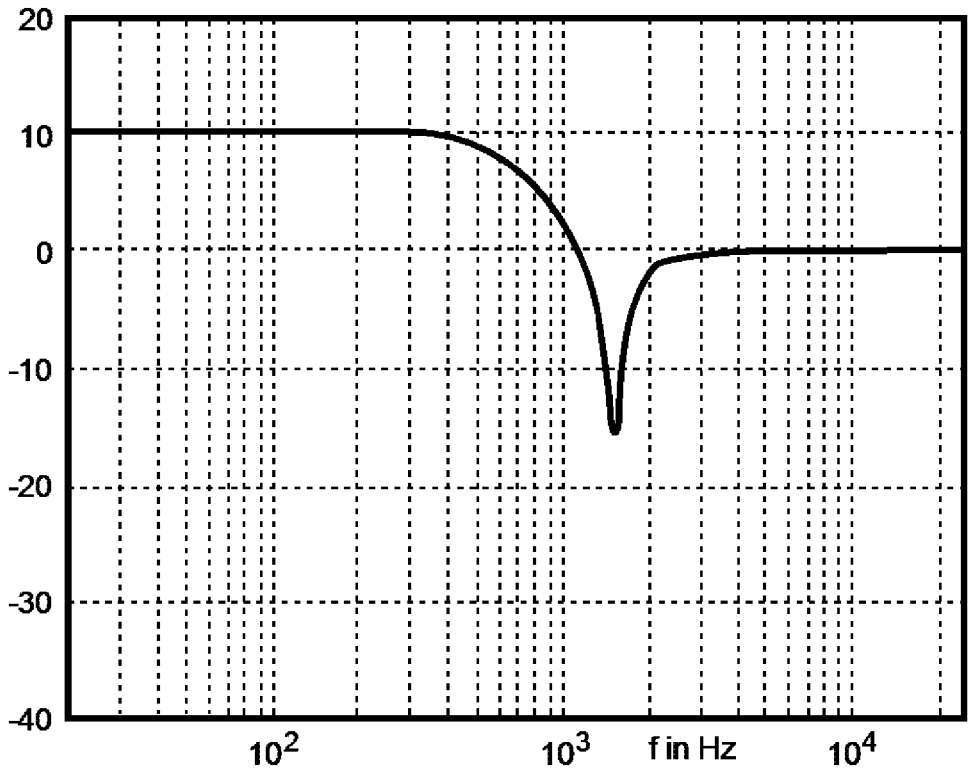
FIG. 21 is a graph of a resulting frequency response of a difference filter D of the stereo widening module of FIG. 19.

In FIG. 19, depicted is a general approach to stereo widening. A monaural source 1902 is to be arranged beyond a left and right loudspeaker 1904 and 1906, respectively. The loudspeakers 1904 and 1906 output sound waves that radiate into a room before they reach the ears, which are modeled simplistically to simulate sound waves having direct and indirect paths. The sound waves having indirect paths to the ears can be simulated by a pair of cross filters 1908 and 1910. From this model, a design system can develop input filters 1912 and 1914 ("S" and "D", respectively) where sound waves perceived by the ear are characterized by a new direct path 1916, which is again set to one, and a new cross path 1918, which corresponds to wider source angles than those portrayed by the pair of cross filters 1908 and 1910. With given filter responses from the new cross path 1918 ("PC") and the cross filters 1908 and 1910 ("HC"), the following transfer functions can be obtained from FIG. 19. The frequency responses of the filters "S" and "D" are graphed in FIGS. 20 and 21, respectively, and the following equations represent the filters.

$$S=(1+P_C)/(1+H_C)$$

$$D=(1-P_C)/(1-H_C)$$

An example of such an application could use the cross filters described above. For example, applying the Hc90 filter for PC and the Hc45 filter for HC, the application of the SES can achieve a widening effect from initially 45 degrees (which is the actual speaker location) to 90 degrees (which is a virtual location).

Figure 22:
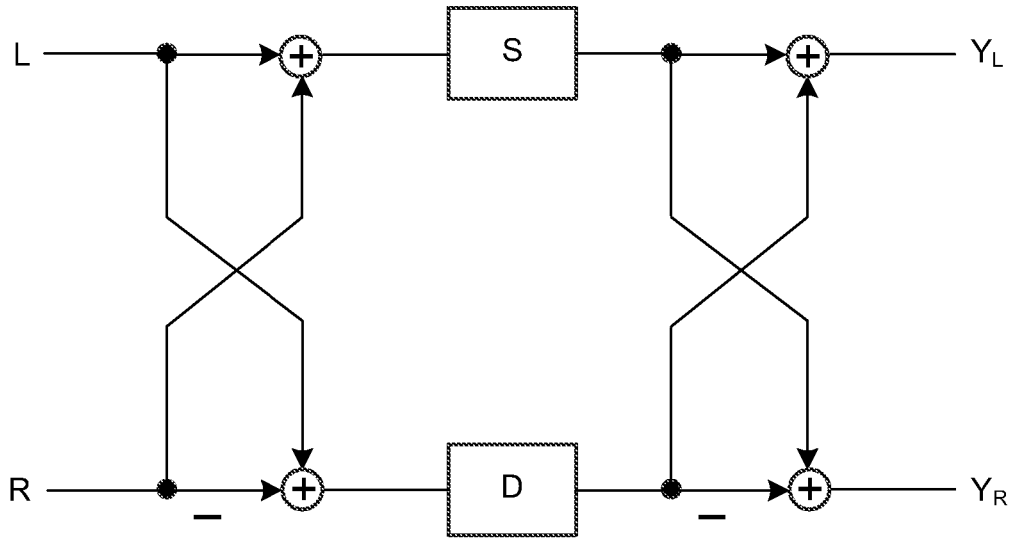
FIG. 22 is a signal flow chart of a stereo widening circuit used by an embodiment of the SES.

Furthermore, the scheme of FIG. 19 can be used to simulate a stereo or surround sound system. For example, in FIG. 22, depicted is a scheme for a stereo system employing the aforementioned design techniques. In this scheme for a stereo system, the parametric binaural model or SES derives the S and D filters.

It will be understood, and is appreciated by persons skilled in the art, that one or more processes, sub-processes, or process steps or modules described in connection with the above text and corresponding figures may be performed by hardware and/or software. If the process is performed by software, the software may reside in software memory (not shown) in a suitable electronic processing component or system such as a microprocessor, personal computer, mobile electronic device, or a stereo or surround sound system. The software in software memory may include an ordered listing of executable instructions for implementing logical functions (that is, "logic" that may be implemented either in digital form such as digital circuitry or source code), and may selectively be embodied in any computer readable media for use by or in connection with an instruction execution system, apparatus, or device, such as a computer-based system, processor-containing system, or other system that may selectively fetch the instructions from the instruction execution system, apparatus, or device and execute the instructions. In the context of this disclosure, a "computer-readable medium" is any tangible non-transitory means that may contain, store or communicate the program for use by or in connection with the instruction execution system, apparatus, or device. The computer readable medium may selectively be, for example, but is not limited to, an electronic, magnetic, optical, electromagnetic, infrared, or semiconductor system, apparatus or device. More specific examples, but nonetheless a non-exhaustive list, of computer-readable media would include the following: a portable computer diskette (magnetic), a RAM (electronic), a read-only memory "ROM" (electronic), an erasable programmable read-only memory (EPROM or Flash memory) (electronic) and a portable compact disc read-only memory "CDROM" (optical). Note that the computer-readable medium may even be paper or another suitable medium upon which the program is printed and captured from and then compiled, interpreted or otherwise processed in a suitable manner if necessary, and then stored in a computer memory.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A system for enhancing reproduction of sound, comprising a parametric binaural module filter for transforming a first electromagnetic audio signal to a second electromagnetic audio signal, where:

the parametric binaural module filter comprises one or more of a sum filter and a cross filter; and the sum filter and the cross filter are derived from one or more known direct head-related transfer functions and one or more known indirect head-related transfer functions;

where the derivation of the sum filter and the cross filter are from a processor configured to transform the one or more known direct head-related transfer functions and the one or more known indirect head-related transfer functions to one or more sum transfer functions and one or more cross transfer functions;

where the processor configured to transform the one or more known direct head-related transfer functions and the one or more known indirect head-related transfer functions to the one or more sum transfer functions and the one or more cross transfer functions is further configured to:

determine one or more parameters across the one or more sum transfer functions and the one or more cross transfer functions that are common to the one or more sum transfer functions and the one or more cross transfer functions; and a switch to select various sets of the one or more parameters that are common to the one of more sum transfer functions and the one of more cross transfer functions, where the processor configured to transform the one or more known direct head-related transfer functions and the one or more known indirect head-related transfer functions to the one or more sum transfer functions and the one or more cross transfer functions is further configured to:

average the one or more known direct head-related transfer functions and the one or more known indirect head-related transfer functions, which results in the one or more sum transfer functions; and divide the one or more known indirect head-related transfer functions by the one or more sum transfer functions, which results in the one or more cross transfer functions.

2. The system of claim 1, where the second electromagnetic audio signal comprises an direct head-related transfer function and an indirect head-related transfer function.

3. The system of claim 1, where the processor configured to transform the one or more known direct head-related transfer functions and the one or more known indirect head-related transfer functions to the one or more sum transfer functions and the one or more cross transfer functions is further configured to:

normalize the one or more known direct head-related transfer functions and the one or more known indirect head-related transfer functions;

smooth the normalized one or more known direct head-related transfer functions and the one or more known indirect head-related transfer functions; and limit the one or more known direct head-related transfer functions and the one or more known indirect head-related transfer functions to a first frequency band.

4. The system of claim 1, where the processor configured to transform the one or more known direct head-related transfer functions and the one or more known indirect head-related transfer functions to the one or more sum transfer functions and the one or more cross transfer functions is further configured to:

perform a low order approximation of the one or more sum transfer functions and the one or more cross transfer functions.

5. The system of claim 1, where the parametric binaural module filter further comprises one or more inter-aural delay filters.

6. The system of claim 1, further comprising a distance renderer module.

7. The system of claim 1, further comprising a headphone equalizer module.

8. A sound enhancement system configured for transforming one or more of a first single channel audio signal or a first multichannel audio signal to a second multichannel audio signal while maintaining one or more of stereo or surround sound enhancements and limiting unwanted artifacts, where:

the sound enhancement system comprises a parametric binaural module filter that comprises one or more of a sum filter and a cross filter;

the sum filter and the cross filter are derived from one or more first direct head-related transfer functions and one or more first indirect head-related transfer functions, where the sum filter configured to transform the one or more known direct head-related transfer functions and the one or more known indirect head-related transfer functions to the one or more sum transfer functions, the one cross transfer functions is further configured to average the one or more known direct head-related transfer functions and the one or more known indirect head-related transfer functions, which results in the one or more sum transfer functions and divide the one or more known indirect head-related transfer functions by the one or more sum transfer functions, which results in the one or more cross transfer functions; and a switch to select from a set of Q factor parameters for the sum filter and the cross filter that have common parameters.

9. The sound enhancement system of claim 8, where the second multichannel audio signal includes one or more second direct head-related transfer functions and one or more second indirect head-related transfer functions.

10. The sound enhancement system of claim 8, where the system is configured to transform one or more of a 5.1 surround sound signal and a 7.1 surround sound signal to a binaural audio signal.

11. The sound enhancement system of claim 8, where the system is configured to transform a two-channel stereo sound signal to a binaural audio signal.

12. The sound enhancement system of claim 8, where the sound enhancement system formats the second multichannel audio signal for headphones.

13. The sound enhancement system of claim 8, where the sound enhancement system formats the second multichannel audio signal for loudspeakers.

14. A method for enhancing reproduction of sound, comprising a parametric binaural module filter for transforming one or more electromagnetic audio signals to one or more enhanced electromagnetic audio signals, comprising:

receiving a first electromagnetic audio signal at a first electromagnetic audio signal interface;

communicating from the first electromagnetic audio signal interface the first electromagnetic audio signal first to a sum filter to produce a sum filter output;

communicating the sum filter output to a cross filter to produce a cross filter output;

transforming the first electromagnetic audio signal to a second electromagnetic audio signal comprising a direct head-related transfer function and an indirect head-related transfer function using the sum filter output and the cross filter output; and communicating from the sum filter and the cross filter the second electromagnetic audio signal to a second electromagnetic audio signal interface;

where the communicating from the first electromagnetic audio signal interface the first electromagnetic audio signal to the sum filter and the cross filter, comprises:

communicating from the first electromagnetic audio signal interface the first electromagnetic audio signal directly to the sum filter which in turn communicates a third electromagnetic audio signal to the cross filter that outputs a fourth electromagnetic audio signal that includes the indirect head-related transfer function;

multiplying the third electromagnetic audio signal by a factor; and summing the multiplied third electromagnetic audio signal and the fourth electromagnetic audio signal, which results in a fifth electromagnetic audio signal that includes the direct head-related transfer function.

15. The method of claim 14, further comprising distance rendering the first electromagnetic audio signal prior to the receiving the first electromagnetic audio signal at the first electromagnetic audio signal interface.

16. The method of claim 14, further comprising equalizing the second electromagnetic audio signal.

17. The method of claim 14, further comprising delaying the fourth electromagnetic audio signal.

18. The method of claim 14, wherein the factor is two.

19. The system of claim 1, further comprising a distance renderer configured to provide distance information to the processor, the distance renderer includes a plurality of delay lines for a plurality of input and a summing circuit to sum delayed signals from the plurality of delay lines.

* * * * *